US006419563B1

(12) United States Patent
Ido et al.

(10) Patent No.: US 6,419,563 B1
(45) Date of Patent: Jul. 16, 2002

(54) METHOD OF AND AN APPARATUS FOR MACHINING A WORKPIECE WITH PLURAL TOOL HEADS

(75) Inventors: Masahiro Ido; Kenji Matsuba, both of Kariya; Yasunari Oda, Chiryu, all of (JP)

(73) Assignee: Toyoda Koki Kabushiki Kaisha, Kariya (JP)

( * ) Notice: Subject to any disclaimer, the term of this patent is extended or adjusted under 35 U.S.C. 154(b) by 52 days.

(21) Appl. No.: 09/673,000

(22) Filed: Sep. 29, 2000

(30) Foreign Application Priority Data

Sep. 30, 1999 (JP) ..... 11-280724

(51) Int. Cl.[7] ..... B24B 49/00; B24B 5/42

(52) U.S. Cl. ..... 451/57; 451/8; 451/49; 451/62

(58) Field of Search ..... 451/57, 8, 5, 14, 451/49, 249, 399, 142, 62

(56) References Cited

U.S. PATENT DOCUMENTS 2,054,364 A * 9/1936 DeLeeuw ..... 451/349
5,367,866 A * 11/1994 Phillips ..... 451/307
5,951,377 A * 9/1999 Vaughn et al. ..... 451/49
6,149,503 A * 11/2000 Laycock ..... 451/49

FOREIGN PATENT DOCUMENTS

| | | | |
|---|---|---|---|
| EP | 0791873 | * 8/1997 | ..... 451/49 |
| JP | 54-71495 | 6/1979 | |
| JP | 63-47065 | 2/1988 | |
| JP | 6-278019 | 10/1994 | |

* cited by examiner

*Primary Examiner*—Robert A. Rose
(74) *Attorney, Agent, or Firm*—Oblon, Spivak, McClelland, Maier & Neustadt, P.C.

(57) ABSTRACT

A machining apparatus simultaneously machining at least two portions of one workpiece is disclosed. The machining apparatus includes a worktable unit for rotatably driving workpiece, at least two tool heads each of which supports a tool and moves forward to or away from the workpiece, at least two gauging units measuring a diameter of each portion, and control unit controlling motion of each wheel head individually. The control unit controls motions of the wheel heads in according to signals provided from the gauging units, wherein controls all of tool heads to execute a finish grinding process, controls one tool head corresponding to one portion whose diameter became a required value to back off, and controls all of tool heads to execute a spark-out process after diameters of all of the portions became each required value. Therefore, it can prevent that accuracy of one portion machined by one tool head is deteriorated by effect of machining by another wheel head.

8 Claims, 12 Drawing Sheets

METHOD OF AND AN APPARATUS FOR MACHINING A WORKPIECE WITH PLURAL TOOL HEADS

BACKGROUND OF THE INVENTION

1. Field of the Invention

This invention relates to a method of and an apparatus for machining a workpiece with plural tool heads, more particularly, to a method of and an apparatus for in-process machining simultaneously plural portions of one workpiece with plural tool heads each of which have a tool.

2. Description of the Related Art

As disclosed in Japanese Laid-Open Patent Application No. S54(1979)-71495, it is known such a grinding machine which grinds two pin portions of one crankshaft eccentrically moving around its journal portion as rotational center, in which two wheel heads are independently advanced and retracted synchronously with a rotation of a main spindle.

Meanwhile, International Patent Publication (PCT) WO97/12724 discloses an in-process gauging apparatus. This gauging apparatus can measure a diameter of a pin portion that is moving eccentrically during grinding process.

Generally, a cylindrical grinding is executed by three processes that are rough grinding process, finish grinding process and spark-out process in this order. In the finish grinding process, a diameter of a pin portion is measured by such as above described in-process gauge. When the measured diameter of the pin portion became a required value, feed motion of a wheel head is stopped and rotation of a main spindle is kept. The spark-out process is executed to keep the wheel head in its stopped position during predetermined time or predetermined number of a workpiece rotation. The grinding in the spark-out process removes deflection of the workpiece that is occurred during rough grinding process of finish grinding process. Therefore, it improves accuracy of radial dimension and roundness of the grinding portion.

As to a grinding machine that has two wheel heads, motion of each wheel head is controlled independently. Because two diameters of grinding portions before grinding are different and conditions of two grinding wheels are different, grinding processes by two wheel heads are not progress in same condition. Namely it happens that when the diameter of the portion which is ground by one grinding wheel become a required value and the spark-out process is started, it can be happened a diameter of another portion which is ground by another grinding wheel has not become a required value. In the spark-out process by one grinding wheel, a workpiece is deflected by a grinding force occurred by another grinding wheel which is still executing finish grinding process. Therefore, accuracy of diameter and roundness of the portion ground by one grinding wheel is deteriorated by effect of the grinding by another grinding wheel.

SUMMARY OF THE INVENTION

Accordingly, an object of the present invention is to solve the above mentioned problems and is to provide a machining method of and apparatus for simultaneously machining at least two machining portions of a workpiece with plural tool heads, in which a deterioration is prevented in machining an accuracy of a diameter and roundness of one machined portion by effect of another machining portion.

Another object of the present invention is to provide a machining method of and apparatus for simultaneously machining at least two machining portions of a workpiece with plural tool heads, which enables to perform machining in short cycle-time.

In order to achieve the above objects, the present invention provides an improved machining method of simultaneously machining at least two machining portions of a workpiece with plural tool heads. The machining method comprising: executing a first machining process for the machining portions under measuring each diameter of the machining portions; backing off one tool head predetermined distance, one tool head corresponds one machining portion whose diameter became a required value during the first machining process; and executing a second machining process for the machining portions after diameters of all of the machining portions became each required value.

Since one tool head corresponding to one machining portion whose diameter became a required value first is backed off and a tool of one wheel head is disengaged the machining portion, the tool of one wheel head does not effect any influence to machining for another machining portions. Therefore, machining force acted to workpiece by each tool is not imbalanced, so that it can achieve high accuracy machining without lengthening a machining cycle-time.

In order to achieve the above objects, the present invention provides an improved machining apparatus for simultaneously machining at least two machining portions of a workpiece with plural tool heads. The machining apparatus comprising: a base; a worktable until arranged on the base, which rotatably support the workpiece around predetermined axis; at least two tool heads movably arranged on the basis in a direction to cross the rotational axis of the workpiece, each of the tool heads supports a tool; feeding units corresponding to the tool heads, the feeding units move each of the tool heads; gauging units arranged corresponding to each of the machining portions, said gauging units measure each diameter of the machining portions at least during a first machining process; and a control unit controlling the feeding units according to signals of diameters provided from each of the gauging units. Further, the control units controls all of the feeding units to execute a first machining process; controls one feeding unit to back off one tool head predetermined distance, one tool head corresponds one machining portion whose diameter became a required value during the first machining process; and controls all of the feeding units to execute a second machining process for the machining portions after diameters of all of the machining portions became each required value.

Since one tool head corresponding to one machining portion whose diameter became a required value first is backed off and a tool of one wheel head is disengaged the machining portion, the tool of one wheel head dose not effect any influence to machining for another machining portions. Therefore, machining force acted to workpiece by each tool is not imbalanced, so that it can achieve high accuracy machining without lengthening a machining cycle-time.

BRIEF DESCRIPTION OF THE ACCOMPANYING DRAWINGS

Various other object, features and many of the attendant advantages of the present invention will be readily appreciated as the same becomes better understood by reference to the following detailed description of preferred embodiments when considered in connection with the accompanying drawings, in which FIG. 1 is a top plane view of a grinding machine according to an embodiment of the present invention;

Figure 4A:
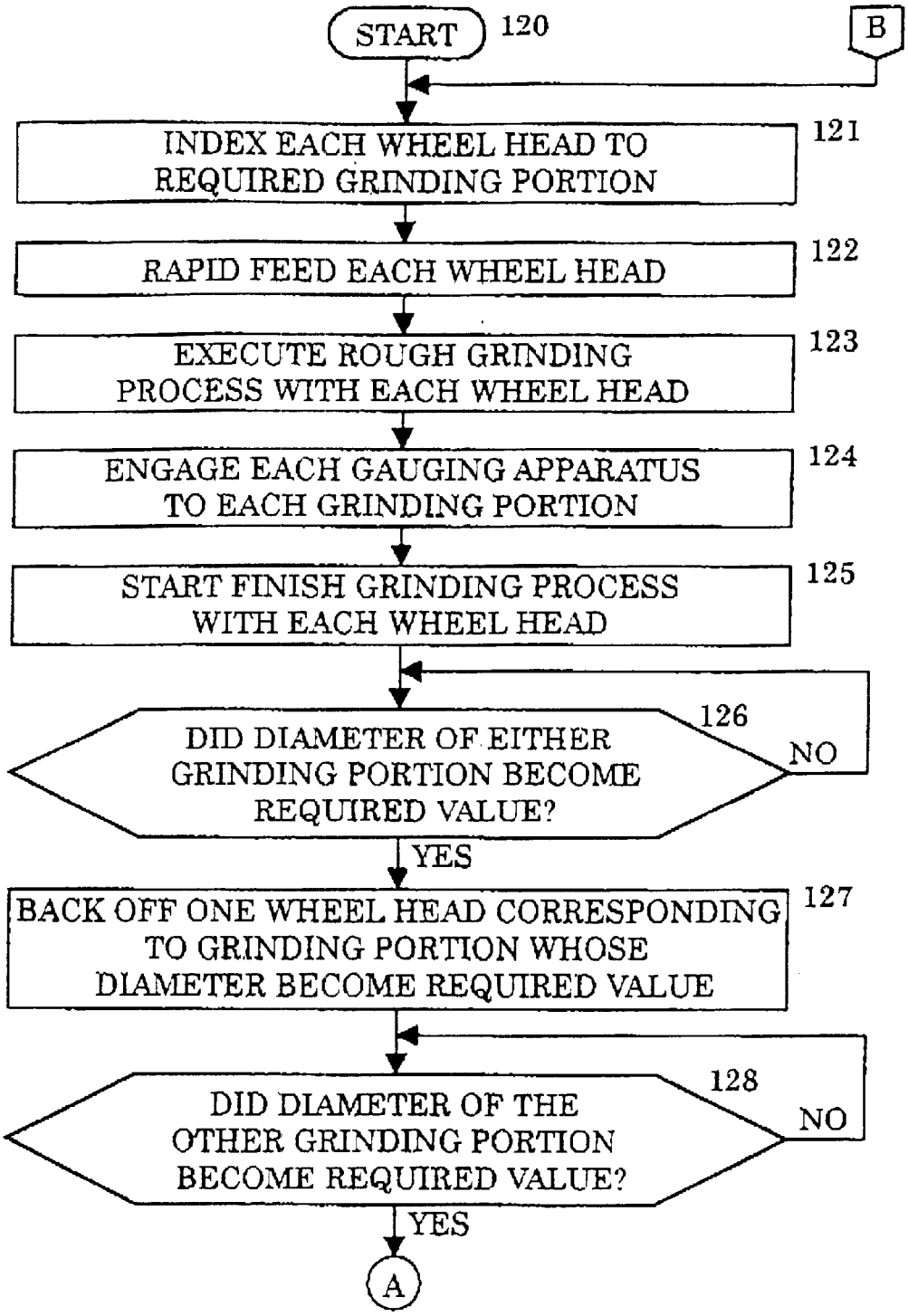
Figure 4B:
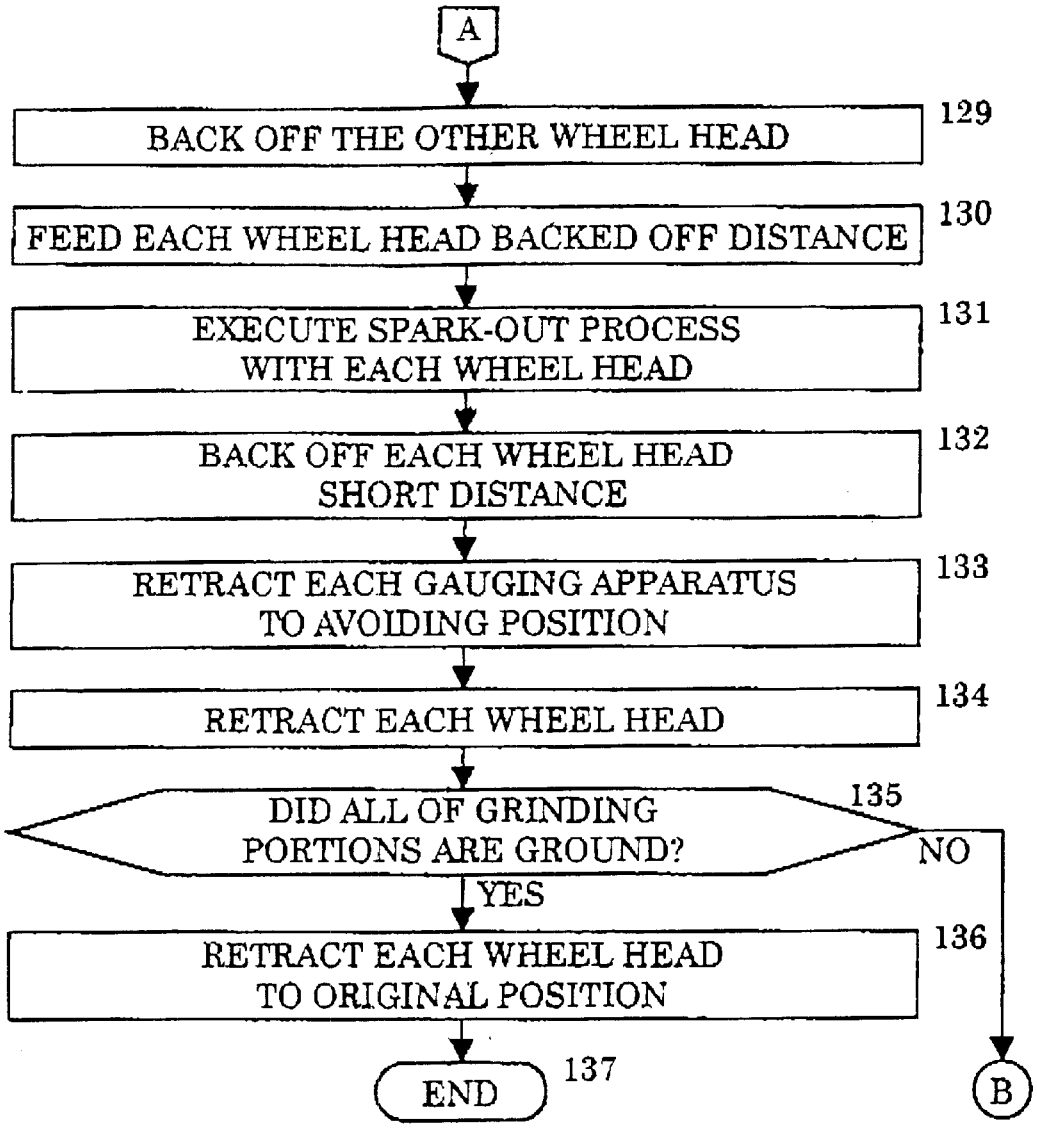
Figure 5:
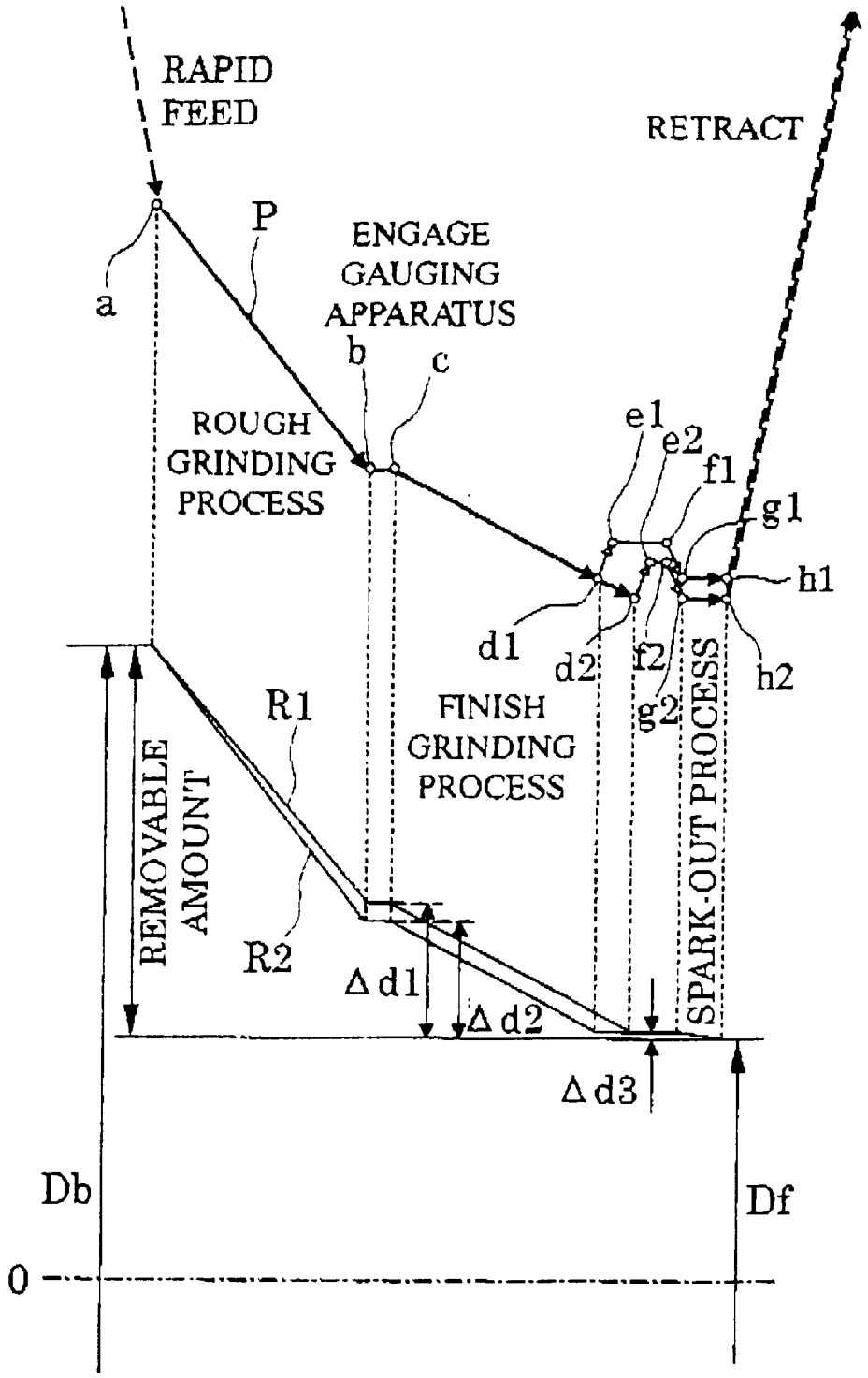
Figure 6A:
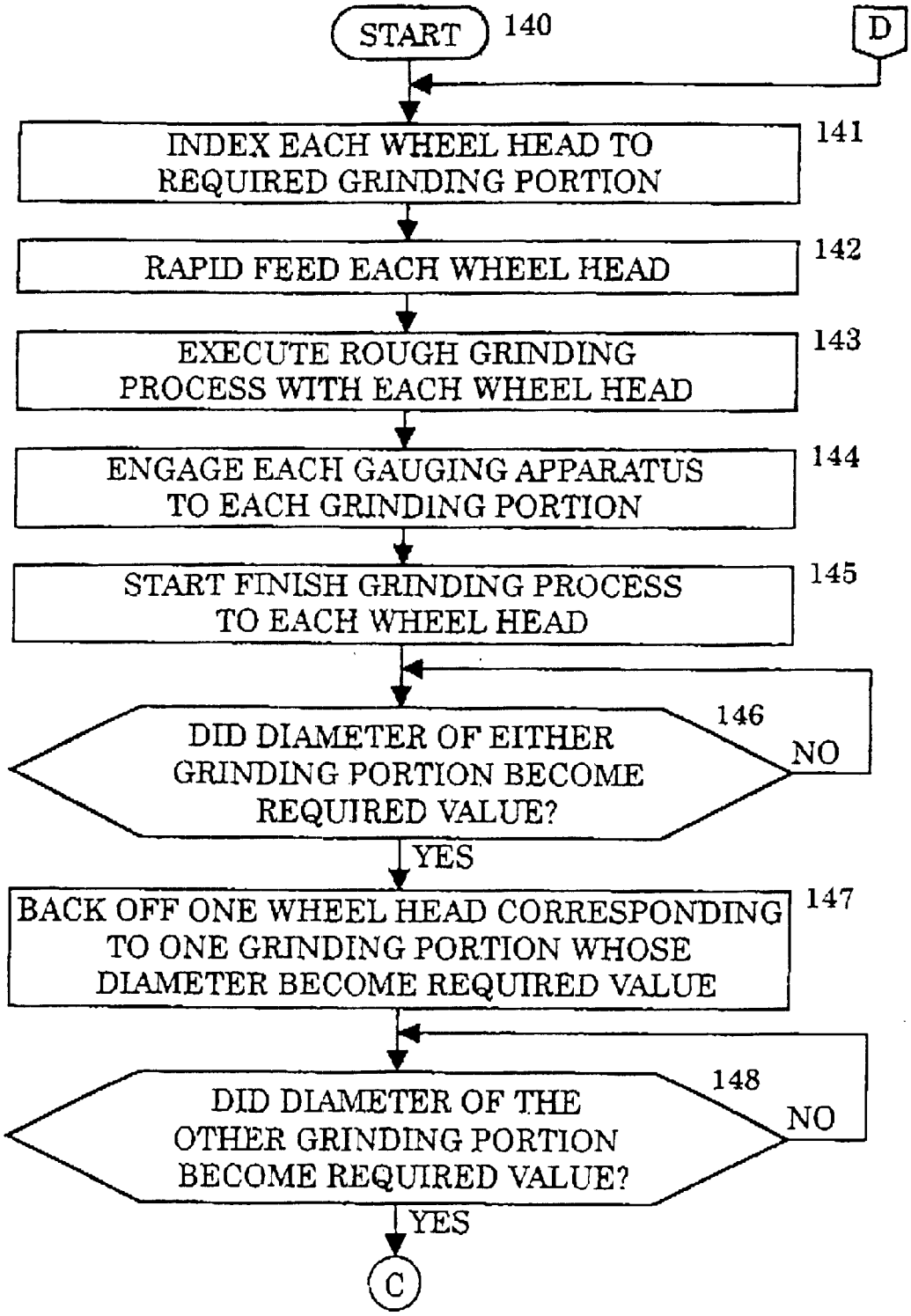
Figure 6B:
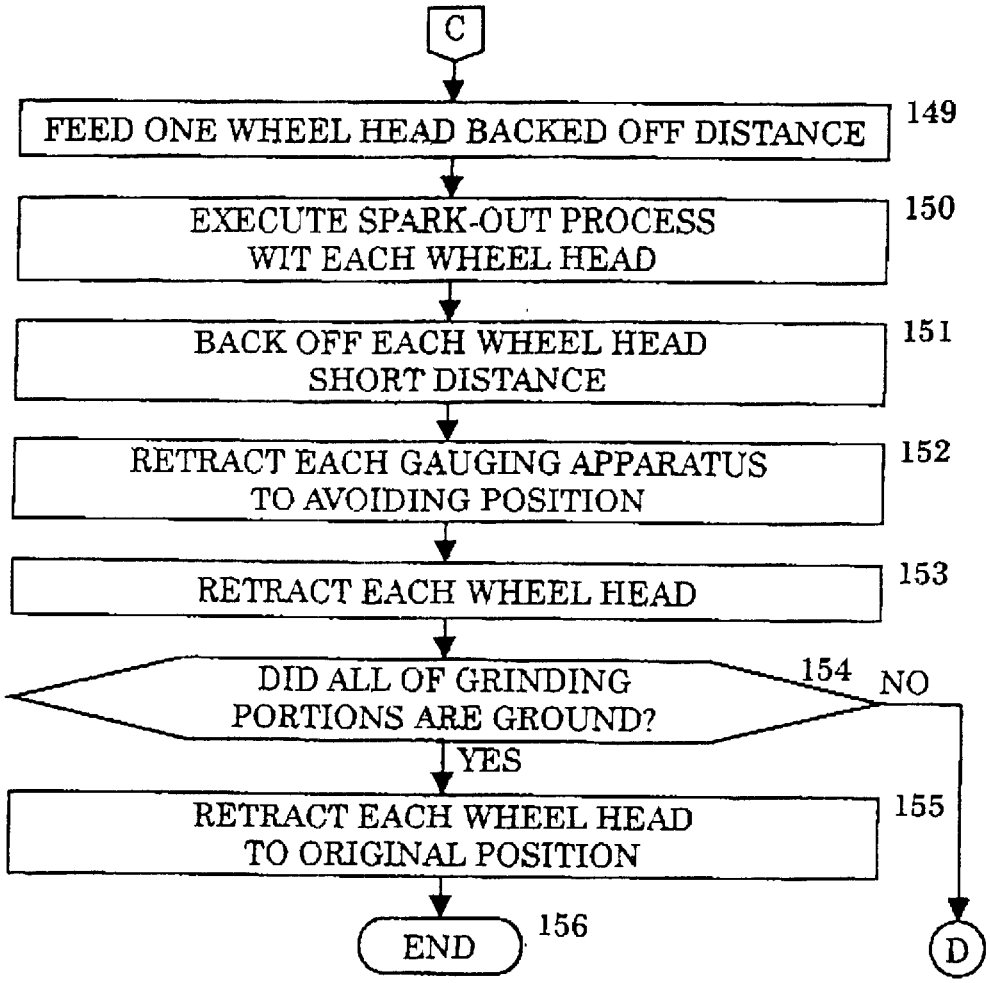
Figure 7A:
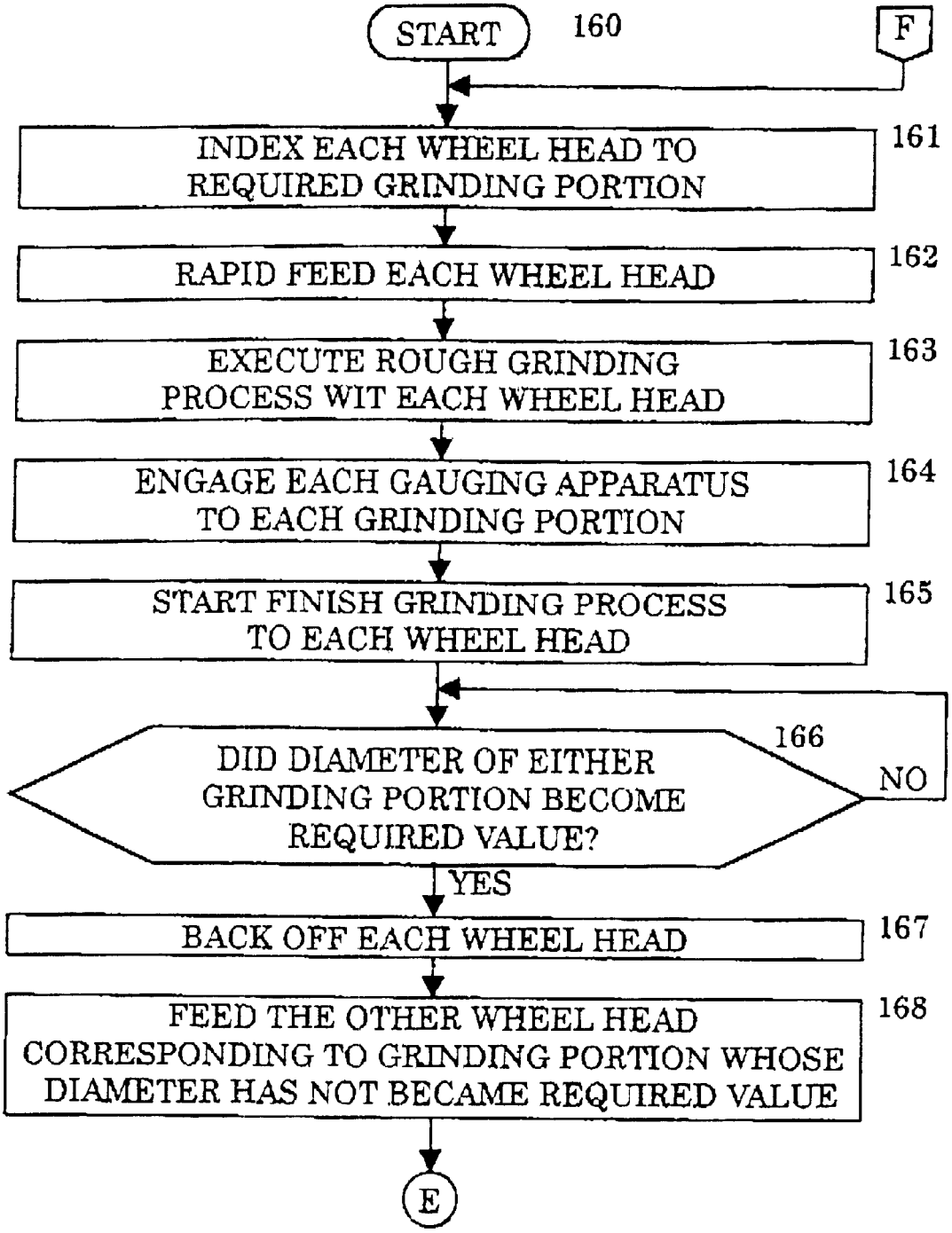
Figure 7B:
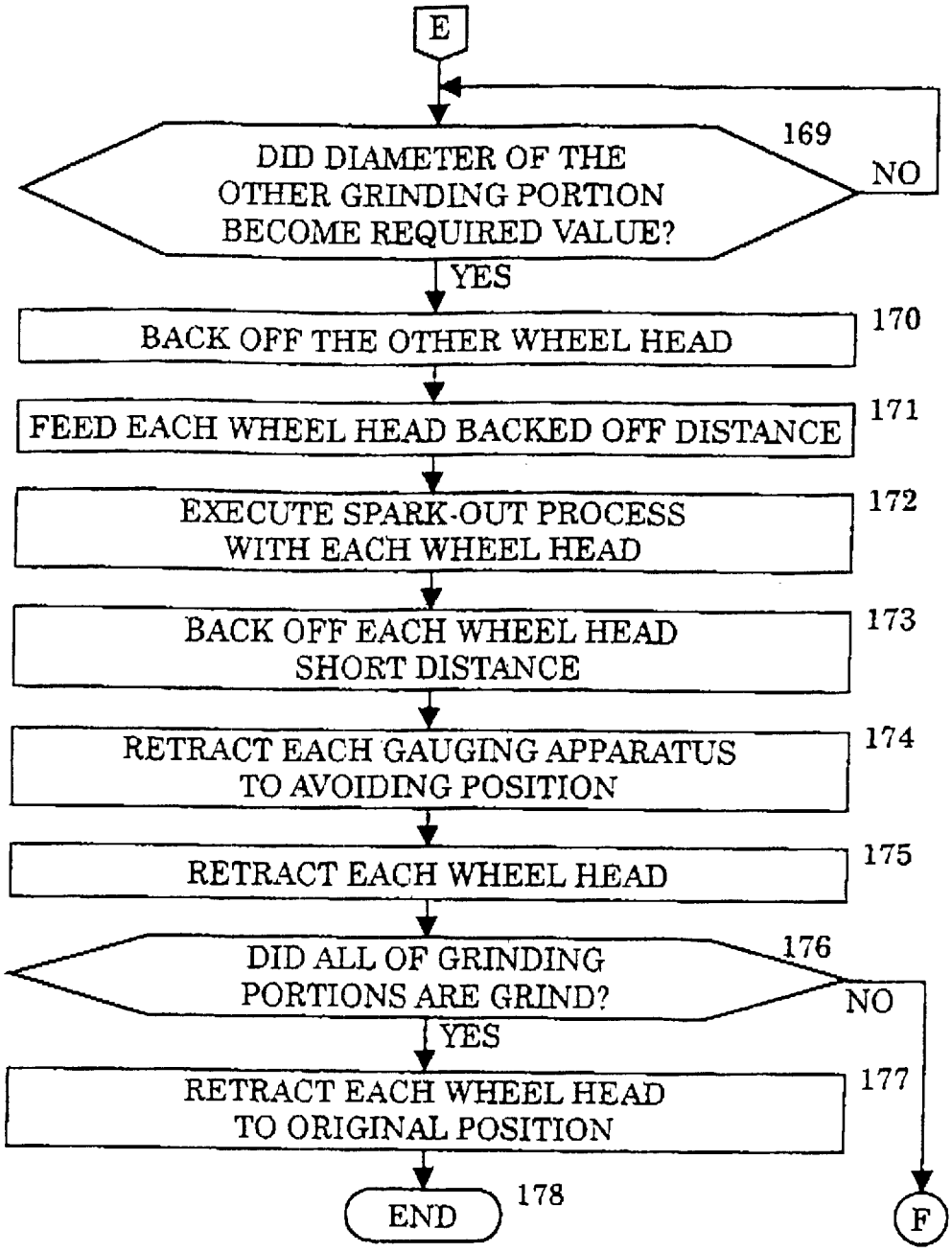
Figure 8A:
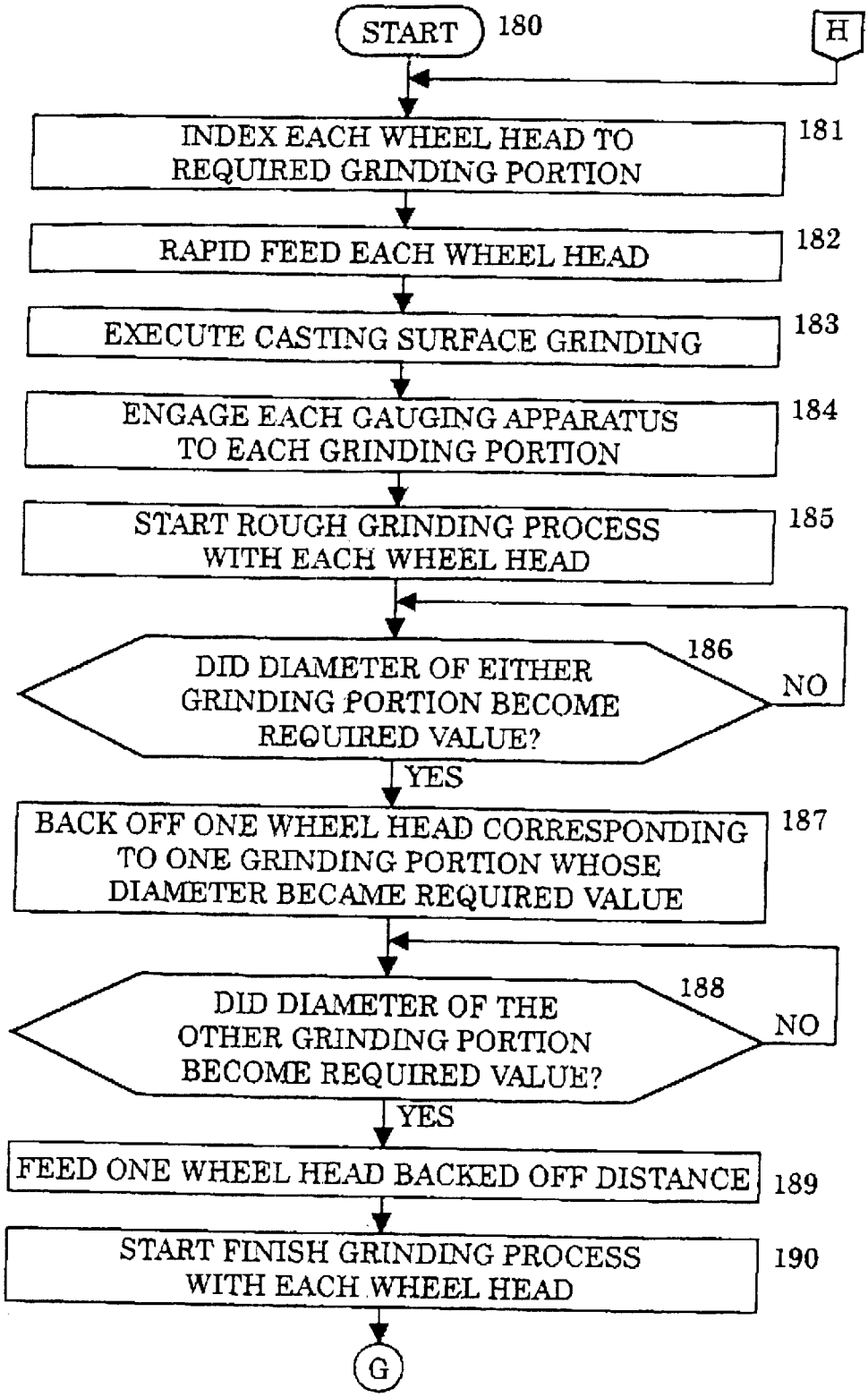
Figure 8B:
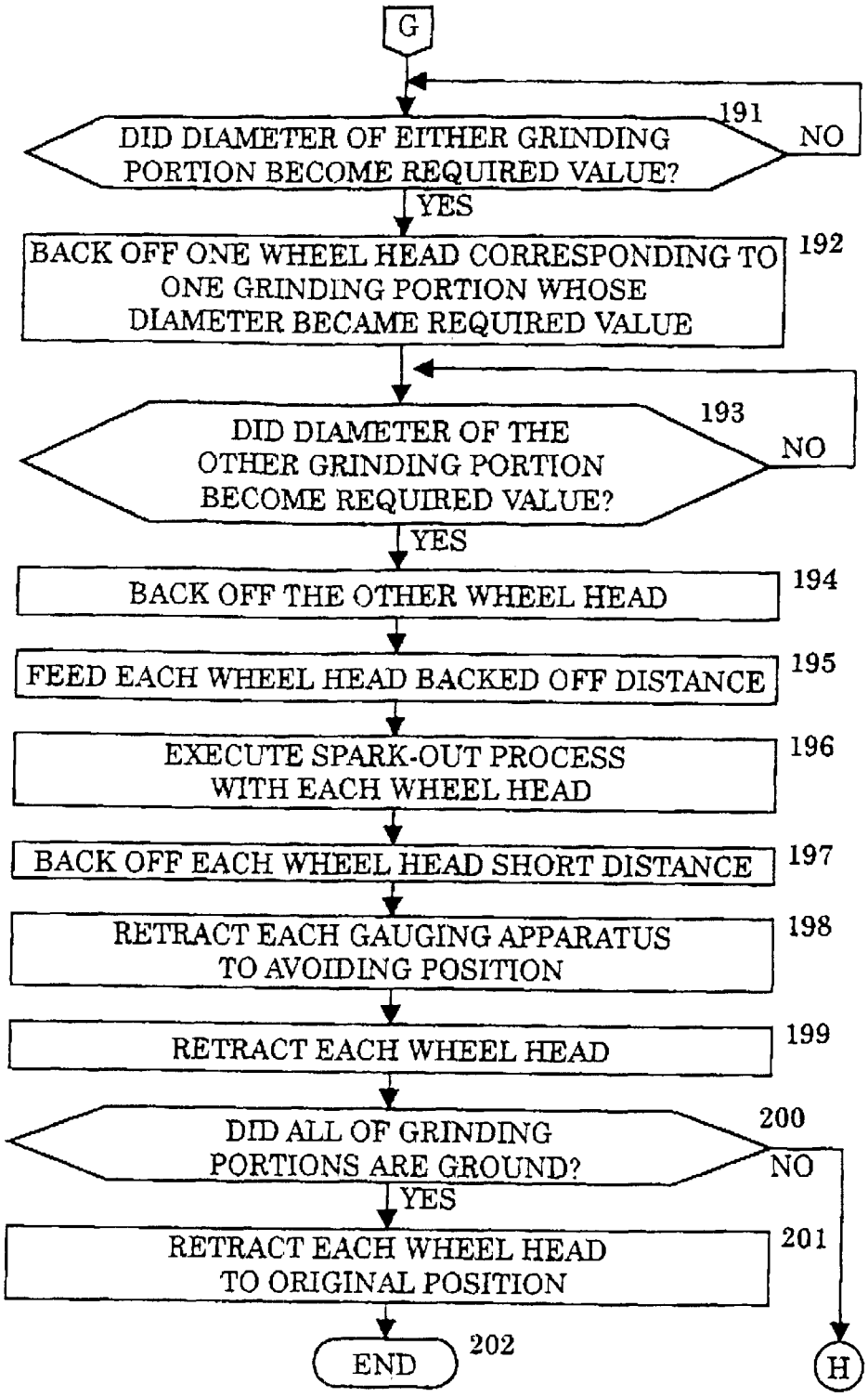

FIG. 4*a* and FIG. 4*b* are a flowchart showing a machining program according to a first control mode of the embodiment of the present invention;

FIG. 5 is a cycle chart showing a relation of positions of tool heads and diameters of grinding portions according to the first control mode;

FIG. 6*a* and FIG. 6*b* are a flowchart showing a machining program according to a control mode of second embodiment of the present invention;

FIG. 7*a* and FIG. 7*b* are a flowchart showing a machining program according to a control mode of third embodiment of the present invention;

FIG. 8*a* and FIG. 8B are a flowchart showing a machining program according to a control mode of fourth embodiment of the present invention.

DETAILED DESCRIPTION OF THE PREFERRED EMBODIMENTS

Embodiments according to the present invention will be described hereinafter with reference to drawings.

Figure 1:
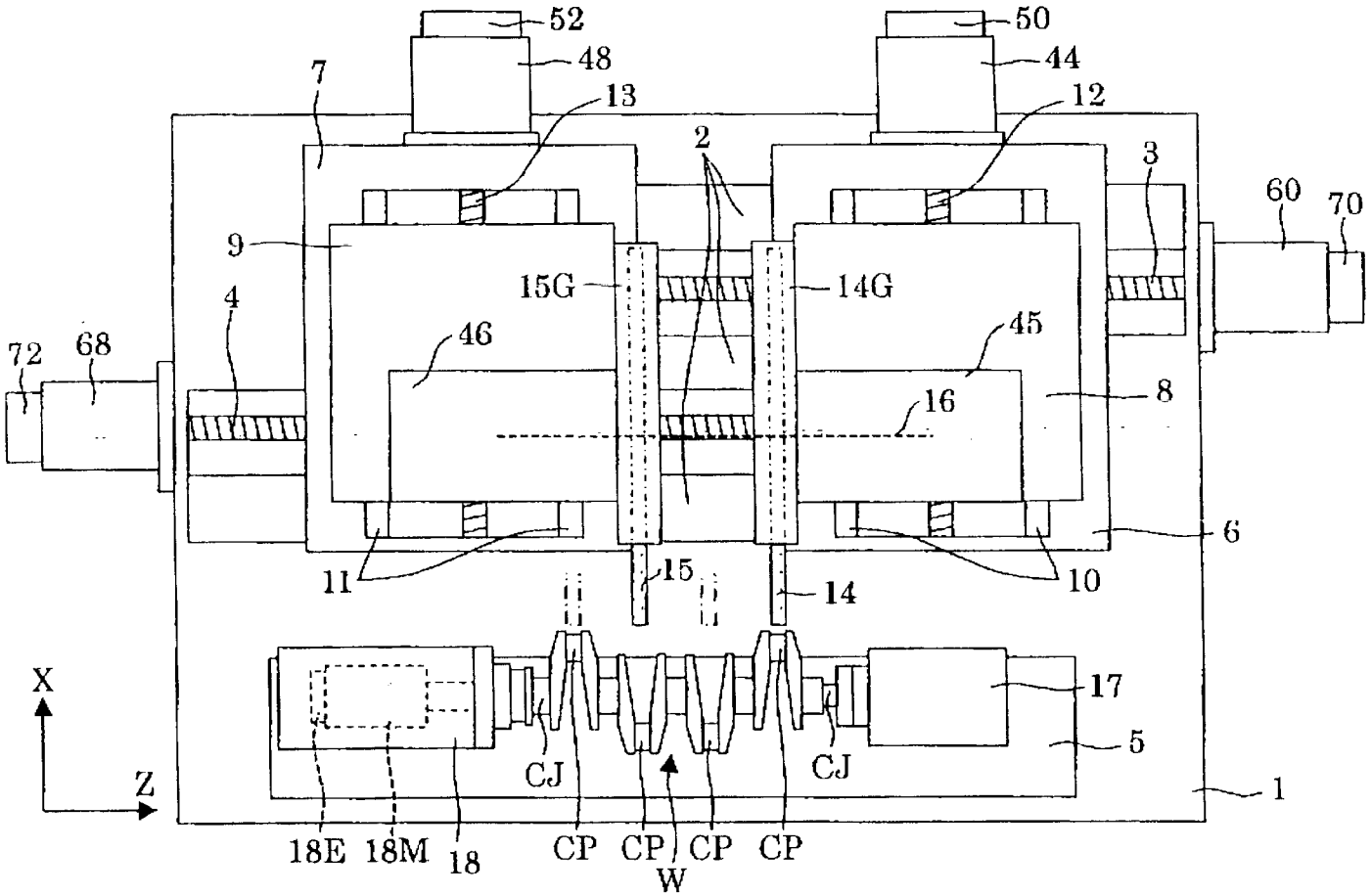

FIG. 1 shows a top plane view of a grinding machine according to the present invention. A grinding machine has a common base 1. On the base 1, Z-axis guide rails 2 are secured to parallel each other along the longitudinal direction of the base 1. In front of the Z-axis guide rails 2, a worktable 5 is fixed parallel to the Z-axis guide rails 2 on the base 1. Further, a right-side table motor 60 to drive a ball screw 3 is fixed on the right portion of the base 1, and a left-side table motor 68 to drive a ball screw 4 is fixed on the left portion of the base 1.

A right-side table 6 and a left-side table 7 are slidably mounted on along the Z-axis guide rails 2 in a Z-axis direction. The right-side table 6 is moved by the right-side table motor 60 and the ball screw 3, in which an encoder 70 is attached the right-side table motor 60 to detect a rotational position thereof. Similarly, the left-side table 7 is moved by the left-side table motor 68 and the ball screw 4, an encoder 72 is attached the left-side table motor 68 to detect a rotational position thereof.

On the right-side table 6, there are arranged fixed pair of X-axis guide rails 10, a right-side wheel head motor 44 and a ball screw 12, in which an encoder 50 is attached to the right-side wheel head motor 44 to detect a rotational position thereof. Similarly, on the left-side table 7, there are arranged fixed pair of X-axis guide rails 11, a left-side wheel head motor 48 and a ball screw 13, in which a encoder 52 is attached to the left-side wheel head motor 48 to detect a rotational position thereof.

A right-side wheel head 8 is slidably mounted on the X-axis guide rails 10 in an X-axis direction, on which a grinding wheel 14 is mounted. The grinding wheel 14 is rotated around a center axis denoted a dotted line 16 at high speed by a wheel motor 45 disposed in the right-side wheel head 8. Similarly, a left-side wheel head 9 is slidably mounted on the X-axis guide rails 11 in the X-axis direction, on which the other grinding wheel 15 is mounted. The grinding wheel 15 is rotated around a center axis denoted the dotted line 16 at high speed by a wheel motor 46 disposed in the left-side head 9. In FIG. 1, reference number 14G, 15G are shown wheel guard attached on each wheel head 8, 9.

On the worktable 5, a work head 18 and a tailstock 17 are arranged. A workpiece such a crankshaft W is rotatably held at each of journal portions CJ, CJ by the work 18 and the tailstock 17. The crankshaft W is rotated around a center axis of the journal portion CJ by a main spindle motor 18M arranged in the work head 18. On the main spindle motor 18M, there is attached an encoder 18E to detect a rotational position of main spindle motor 18M.

Two gauging apparatus 20R and 20L (not shown in FIG. 1) are mounted on the each wheel head 8 and 9, in which each gauging apparatus is able to measure a diameter of a grinding portion of the crankshaft W while the crankshaft W is rotating. Such in-process gauging apparatus is known as aformentioned PCT Publication WO97/12724. Since the gauging apparatus 20L mounted on left-side wheel head 9 and the gauging apparatus 20R mounted on right-side wheel head 8 are similar structure, only the gauging apparatus 20R is described with reference to FIG. 2.

A support member 21 is attached on the right-side wheel head 8. There are first arm 22 and a second arm 23, in which one end of the first arm 22 is connecting pivotably at the support member 21 and other end of the first arm 22 is connecting pivotably at the one end of the second arm 23. Other end of the second arm 23 is connecting at one end of a bar 28. At other end of the bar 28, there is attached V-shape block 25 which contacts a surface of a grinding portion (i.e. pin portion CP of the crankshaft W). A probe 27 is attached at center of the V-shape block 25. The probe 27 is able to move forward to and away from the center of the grinding portion, and always contact the surface of the grinding portion at a gauging position described hereinafter. Accordingly, the diameter of the grinding portion can be measured by detecting a position of the probe 27 relative to the V-shape block 25 electrically.

Figure 2:
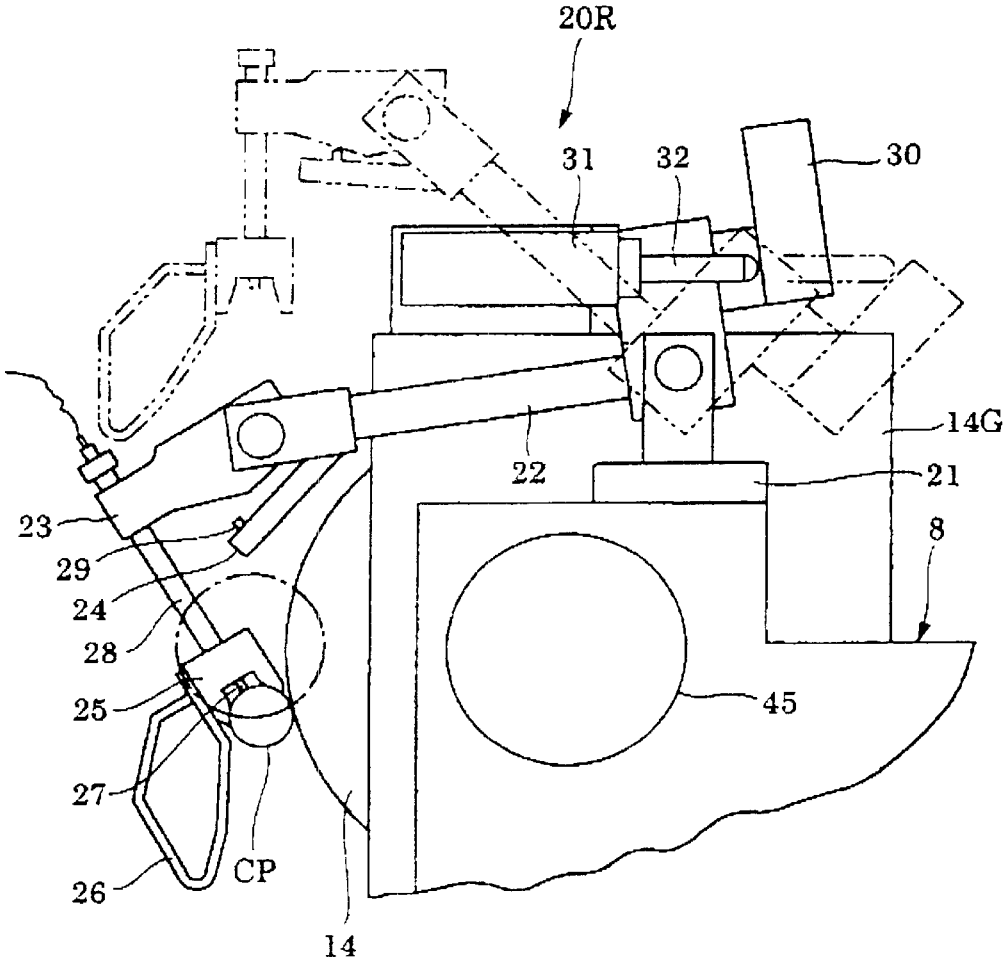
FIG. 2 is a side view of a gauging apparatus according to the embodiment of the present invention.

The gauging apparatus 20R can take two positions, one of which is a gauging position shown in FIG. 2 by solid line and the other is avoiding position shown in FIG. 2 by double-dashed line. A guide member 26 is attached on side surface of the V-shape block 25. The guide member 26 performs to guide the V-shape block 25 to engage a pin portion CP of the crankshaft W, when the gauging apparatus 20R moves from the avoiding position to the gauging position.

There is a hydraulic cylinder 31 attached on the wheel guard 14G. At offset position of the one end of the first arm 22, a lever 30 is attached perpendicular to the first arm 22. When a piston rod 32 of the cylinder 31 pushes the lever 30, the first arm 22 is pivoted clockwise and the V-shape block 25 is moved to the avoiding position. In the avoiding position, a position of the second arm 23 is not fixed, because the V-shape block does not engage to the pin portion CP. A third arm 24 having a support pin 29 is attached the first arm 22 downwardly, consequently the support pin 29 engages the second arm 23 and the position of second arm 23 is fixed.

When the piston rod 32 is retracted (move to left side in FIG. 2), the first arm 22 pivots counterclockwise and the bar 28 moves downward. First the guide member 26 contacts the pin portion CP, next the guide member 26 moves along the pin portion CP, and finally the V-shape block is engaged to the pin portion CP. Then the second arm 23 is able to pivot free, because the third arm 24 does not contact the support pin 29. Therefore, when the pin portion CP moves eccentrically around the center axis of the journal portion CJ as shown a dashed circle in FIG. 2, the V-shape block moves eccentrically to be maintained to engage the pin portion CP always.

Figure 3:
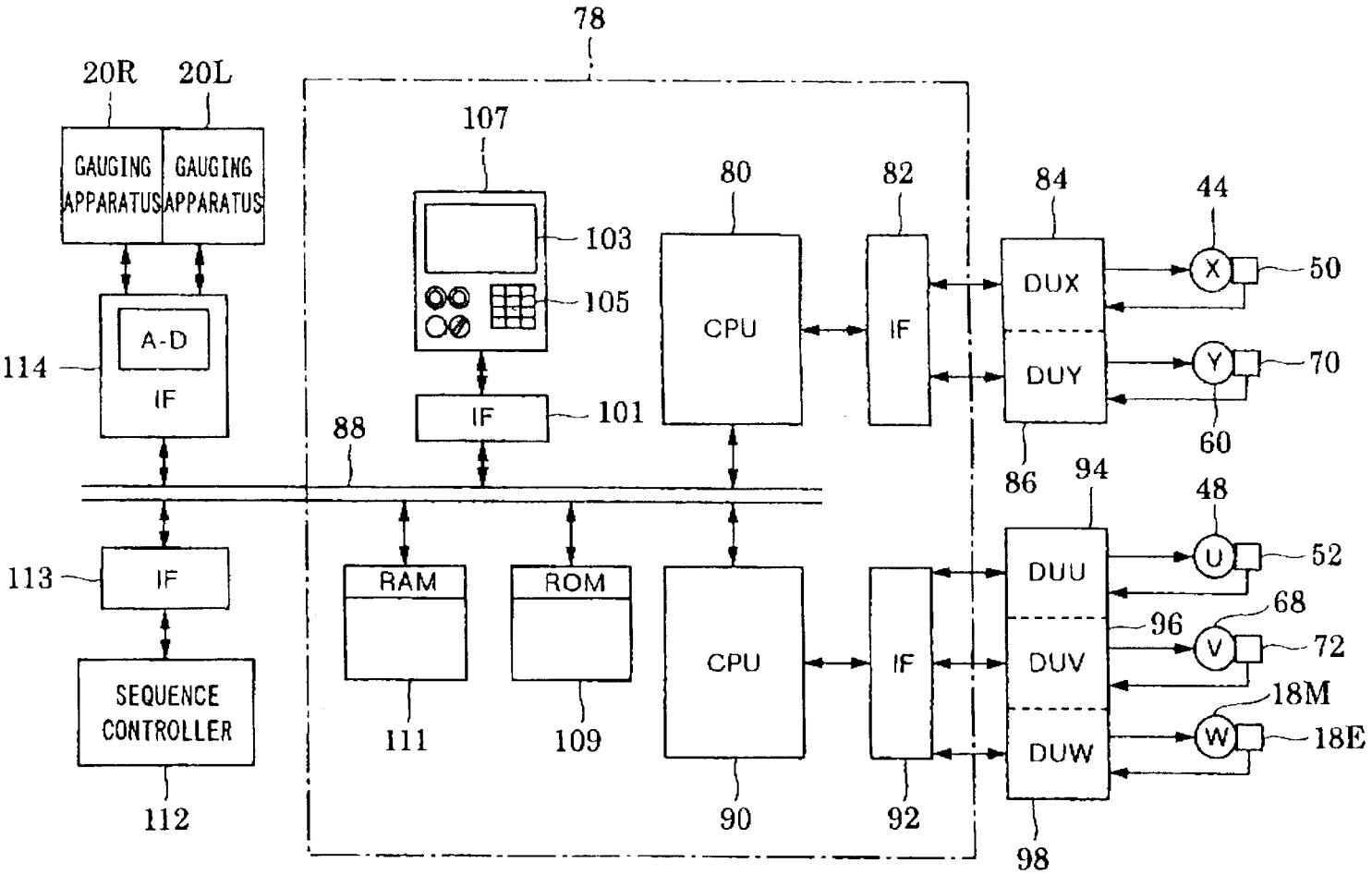
FIG. 3 is a block diagram of numerical control unit according to the embodiment of the present invention.

A numerical control unit 78 controlling the grinding machine is described hereinafter. In FIG. 3, the numerical control unit 78 is composed of an operating box 107, a RAM 111, a ROM 109, CPUs 80 and 90, a signal bus line 88 and interfaces (IFs) 82, 92 and 101. The operating box 107 comprises a key input section 105 and display section 103, and is connected to the signal bus line 88 through the interface 101. The CPU 80 for controlling the right-side table 6 and the right-side wheel head 8 is connected to the signal bus line 88. The CPU 90 for controlling the left-side table 7, the left-side wheel head 9 and the main spindle motor 18M of the work head 18 is connected to the signal bus line 88. Further, the RAM 111 and ROM 109 are connected to the signal bus line 88.

A motor control circuit 86 for controlling the right-side table motor 60 is connected to the CPU 80 via the interface 82, to which an output from the encoder 70 is feedbacked as a detected angle position (rotational position) of the right-side table motor 60. The right-side table motor 60 can be controlled by the motor control circuit 86 so as to make zero a difference between a detected value of the encoder 70 and a target value in the rotational position of the right-side table motor 60.

A motor control circuit 84 for controlling the right-side wheel head motor 44 is connected to the CPU 80 via the interface 82, to which an output from the encoder 50 is feedbacked as a detected angle position (rotational position) of the right-side wheel head motor 44. The right-side wheel head motor 44 can be controlled by the motor control circuit 84 so as to make zero a difference between a detected value of the encoder 50 and a target value in the rotational position of the right-side wheel head motor 44.

Similarity, a motor control circuit 96 for controlling the left-side table motor 68 is connected to the CPU 90 via the interface 92, to which an output from the encoder 72 is feedbacked as a detected angle position (rotational position) of the left-side table motor 68. The left-side table motor 68 can be controlled by the motor control circuit 96 so as to make zero a difference between a detected value of the encoder 72 and a target value in the rotational position of the right-side table motor 68.

A motor control circuit 94 for controlling the left-side wheel head motor 48 is connected to the CPU 90 via the interface 92, to which an output from the encoder 52 is feedbacked as a detected angle position (rotational position) of the left-side wheel head motor 48. The left-side wheel head motor 48 can be controlled by the motor control circuit 94 so as to make zero a difference between a detected value of the encoder 52 and a target value in the rotational position of the left-side wheel head motor 48.

Further, a motor control circuit 98 for controlling the main spindle motor 18M is connected to the CPU 90 via the interface 92, to which an output from the encoder 18E is feedbacked as a detected angle position (rotational position) of the main spindle motor 18M. The main spindle motor 18M can be controlled by the motor control circuit 98 so as to make zero a difference between a detected value of the encoder 18E and a target value in the rotational position of the main spindle motor 18M.

Furthermore, the gauging apparatuses 20R and 20L are connected to the signal bus line 88 via an interface 114 comprising a A/D converter, and a sequence controller 112 is connected to the signal bus line 88 via an interface 113. Signals of diameters of grinding portions detecting by the gauging apparatuses 20R and 20L are input CPUs 80 and 90, to which when a diameter of the grinding portion becomes a target diameter, each of advance movement of the wheel head 8,9 is stopped.

Above described grinding machine is operated as follows.

The workpiece as the crankshaft W is supported between the work head 18 and the tailstock 17. The right-side table 6 and the left-side table 7 is moved by rotation of the right-side table motor 60 and the left-side table motor 68, each position of grinding wheels 14 and 15 in the Z-axis direction is indexed the grinding pin portion CP of the crankshaft W. By the start of rotation of the main spindle motor 18M, the crankshaft W is rotated around its center axis, i.e. center of a journal portion CJ, and so the pin portion CP rotates around the center axis of the journal portion eccentrically. Each of the right-side wheel head 8 and left-side wheel head 9 is independently moved forward to and away from the center of the journal portion CJ by rotation of the right-side wheel head motor 44 and the left-side wheel head motor 48 synchronized with the rotation of the main spindle motor 18M. Accordingly, the pin portion CP is ground to add infeed motion of each wheel head 8,9 to advance or retract movement synchronized to the rotation of the workpiece (i.e. eccentric movement of the grinding portion).

In grinding process, a diameter of the grinding portion is measuring by the gauging apparatus 20R and 20L. That is, the probe 27 always contacts the grinding portion, and the signal of a diameter of a grinding portion detecting as position of the probe 27 is input to the CPUs 80 and 90. Then motion of each wheel head 8 and 9 is controlled by CPUs 80 and 90 according to the signal of the diameter of the grinding portion.

Machining programs for control motion of each wheel head 8, 9 will be explained hereinafter with reference to flowchart shown in FIG. 4, FIG. 6, FIG. 7 and FIG. 8.

1. Control Mode I

Control Mode I as one of the machining programs will be explained hereinafter. Reference to FIG. 4, in step 120 a machining operation is started. In step 121, the right-side wheel head 8 and the left-side wheel head 9 are moved to the Z-axis direction by the right-side table motor 60 and the left-side table motor 68, to which the grinding wheel 14 and 15 are indexed to each required pin portion CP. Next, in step 122, each wheel head 8 and 9 is fed rapidly to the X-axis direction by the right-side wheel head motor 44 and the left-side wheel head motor 48, to which the grinding wheel 14 and 15 approaches each grinding portion. In step 123, feed motion of each wheel head 8 and 9 is changed for rough grinding feed motion which is added infeed motion of rough grinding to advance or retract movement synchronized with the eccentric movement of each grinding portion. Hereby, a rough grinding process is executed.

After the rough grinding process, in step 124, the gauging apparatus 20R and 20L are engaged each grinding portion. That is, when each wheel head 8 and 9 is infed predetermined distance, each infeed motion at the rough grinding process is stopped, and the gauging apparatus 20R and 20L are taken gauging position by cylinder 31, so that V-shape block 25 and prove 27 contact the grinding portion.

In step 125, a finish grinding process is started, i.e. feed motion of each wheel head 8 and 9 is changed for finishing grinding feed motion which is added infeed motion for finish grinding to advance or retract movement synchronized eccentric movement of each grinding portion.

While the finish grinding process is being executed, in step 126 when either gauging apparatus detect a diameter of the grinding portion became a required value, in step 127 one wheel head corresponding to the grinding portion, the diameter of which reaches to became the required value, is backed off short distance, such as 0.1 mm or 0.5 mm, and the grinding wheel of one wheel head is disengaged the grinding portion. During step 126 and 127, as infeed motion of the other wheel head is continued, the finish grinding process of the other grinding portion, which has not become a required value, is being executed with the other wheel head. And, in step 128, as the other gauging apparatus detects a diameter of the other grinding portion became the required value, in step 129 the other wheel head is backed off short distance, such as 0.1 mm or 0.5 mm, and the grinding wheel of the other wheel head is disengaged the grinding portion.

Now, as diameters of the workpiece after the rough grinding process are different and conditions of two grinding wheels 14 and 15 are different, finishing grinding processes by two wheel heads 8 and 9 are not progress in same condition. One wheel head corresponding to the grinding portion whose diameter became the required value first starts to back off and the grinding wheel of one wheel head is disengaged the grinding portion, so that the grinding wheel of one wheel head dose not effect any influence to the finish grinding by the grinding wheel of the other wheel head.

In step 130, each wheel head 8 and 9 are fed to each of starting position of back off in step 127 or 129, and each grinding wheel 14 and 15 contacts each of the grinding portions. In step 131, a spark-out process is executed by each grinding wheel 14 and 15. It completes the spark-out process to pass predetermined time or to rotate the workpiece predetermined number of revolution. In step 132, each wheel head 8 and 9 is backed off a short distance to disengage each of the grinding portions, and in step 133 each gauging apparatus is moved by cylinder 31 to retract to the avoiding position. As each gauging apparatus become to disengage the grinding portion, in step 134 each wheel head is retracted predetermined distance. And in step 135, there are or not any other grinding portion is judged to be ground or not. If there are any other un-ground portion, the machining program returns to step 121. And if all grinding portions have been ground, in step 136 each wheel head is retracted each original position and grinding operation is completed.

Besides, from step 122 to step 134, advance and retract movement synchronized with eccentric movements of each grinding portion is kept and infeed or back off motion is added to the advance and retract motions.

FIG. 5 is a cycle chart showing a relation of positions of both wheel heads and diameters of grinding portions at above described control mode I. In FIG. 5, arrows P show positions of right-side wheel head 8 and left-side wheel head 9, and lines R1 and R2 show conditions of decrease the diameters of the grinding portions. In grinding process, each wheel head is always moved in advance and retract motion synchronized with eccentric movement of each grinding portion, and infeed or back off motion is added these advance and retract motion. But, the arrows P show only infeed or feed and back off motion to each grinding portion, advance and retract movements synchronized with eccentric movement of each grinding portion are not shown.

At a point "a," the rapid feed motion of each wheel head are changed the rough grinding infeed motion. From the point "a" to a point "b," the rough grinding process is executed with each wheel head. When each wheel head 8 and 9 is infed to predetermined position (rough grinding process is finished), infeed motions of each wheel head are stopped at the point "b." From the point "b" to a point "c," the gauging apparatus are engaged each grinding portion. And the finish grinding process is executed from the point "c" to points "d1" or "d2." When a diameter of one grinding portion became the require value, i.e. at the point "d1," one wheel head corresponding to one grinding portion is backed off to a point "e1." And position of the one wheel head is kept from the point "e1" to a point "f1." While infeed motion of the other wheel head corresponding to the other grinding portion whose diameter has not become the required value is continued. When a diameter of the other grinding portion became the required value, i.e. at the point "d2," the other wheel head is backed off to a point "e2." From the point "f1" to a point "gI" and from a point "f2" to a point "g2," each wheel head is fed together. And from the point "g1" to a point "h1" and from the point "g2" to a point "h2," position of relative to the grinding portion of each wheel head is kept, so that the spark-out process is executed. After the each spark-out process, each wheel head is backed off.

In FIG. 5, a length of a line from the point "d1" to the point "g1" and a length of a line from the point "d2" to the point "g2" are enlarged for clear understanding.

According to the present invention, two grinding portions are simultaneously ground by two wheel heads 8 and 9. But, as the grinding process with two heads 8 and 9 do not proceed simultaneously, diameters of two grinding portions do not decrease simultaneously like shown the lines R1 and R2 in FIG. 5. Now in FIG. 5, Db is a diameter of grinding portion before grinding, and Df is a finished diameter. Therefor, a difference in diameters between Db and Df is a removable amount.

In the rough grinding process and the finishing grinding process, as diameters of two grinding portions do not decrease simultaneously, a difference Δd1 between a diameter at the start of the finish grinding process and the finished diameter corresponding one wheel head is different from a difference Δ d2 corresponding the other wheel head. Hereby, times of which diameters of two grinding portion become the required value Df+Δd3 (finish grinding process is completed) are different. If the spark-out process is started as soon as the finish grinding process completes, the spark-out process by one wheel head corresponding to one grinding portion whose diameter became the required value first is executed under a condition of which the workpiece is deflecting for effect of the finish grinding by the other wheel head corresponding to the other diameter which has not become the required value. The spark-out process that is executed expecting a spring-back of the deflection of the workpiece becomes ineffectively, so that accuracy of diameter and roundness of the grinding portion which ground by one wheel head is deteriorated with effect of grinding by the other wheel head.

Therefor, in the present invention one wheel head completes the finish grinding process first, is backed off short distance and is kept its position until the other wheel head completes the finish grinding process. During this process, one wheel head is not infed to grinding portion but advanced and retracted synchronized eccentric motion of each grinding portion. When the finish grinding process of the other wheel head completes, the other wheel head is backed off short distance. Hereby, it becomes not to act grinding force, so that a reflection of the workpiece is spring-backed. After that, each wheel head is fed a distance of backed off. The spark-out process is executed to keep the position of each wheel head during predetermined number of rotation, such as two rotations. And the workpiece is ground only Δd3 correspond to a value of reflection of the workpiece. In FIG. 5, Δd3 is enlarged for clear understanding, in reality Δd3 is very short distance. Consequently, in the present invention grinding force act to workpiece by each wheel head is not imbalanced, so that it can achieve high accuracy grinding.

2. Control Mode II

Control Mode II of the machining programs as second embodiment of the present invention will be explained hereinafter reference to FIG. 6. From step 140 to step 148 is a similar manner from step 120 to step 128 of Control Mode I. That is, machining operation is started (in step 140), each wheel head is indexed to a required grinding portion (in step 141), each wheel head is fed rapidly (in step 142), a rough grinding process is executed (in step 143), each gauging apparatus is engaged each grinding portion (in step 144), a finish grinding process is started (in step 145), and when the gauging apparatus detects a diameter of either grinding portion became a required value, the wheel head corresponding to the grinding portion became the required value is backed off (in step 147).

When the diameter of the other grinding portion became a required value in step 148, a finishing grinding infeed motion of the other wheel head is stopped, and one wheel head is fed only backed off distance in step 147. Accordingly, a spark-out process is executed by each wheel heads in step 150.

Then, during one wheel head being fed from backed off position to spark-out position, the spark-out process of the other wheel head has been executing. Hereby the spark-out process times of both wheel heads are different. But, difference of the spark-out times is very little, because backed off distance of one wheel head is very short. Little difference of the spark-out time dose not cause inaccuracy grinding. Especially, at a case of which an infeed speed at the finish grinding process is slow, for example 2 $\mu$m per one revolution of workpiece, a value of deflection is small, because a grinding force is small. Therefore, as a value of spring-back is small too, it can achieve accuracy of radial dimension and roundness of the grinding portion even if the spark-out process times of both wheel heads are different.

Because manners from step 151 to step 156 are similar manners from step 132 to step 137 of Control Mode I, these are not explained.

According to above described Control Mode II, it has the advantage of shortening a cycle-time relative to the Control Mode I, because the other wheel head is not backed off.

3. Control Mode III

Control Mode III of the machining programs as third embodiment of the present invention will be explained hereinafter reference to FIG. 7. From step 160 to step 160 are similar manners from step 120 to step 126 of Control Mode I or from step 140 to step 146 of Control Mode II. That is, machining operation is started (in step 160), each wheel head is indexed to a required grinding portion (in step 161), each wheel head is fed rapidly (in step 162), a rough grinding process is executed (in step 163), each gauging apparatus is engaged each grinding portion (in step 164), and a finish grinding process is started (in step 165).

Consequently, when the gauging apparatus detects a diameter of either grinding portion became a required value in step 166, both wheel heads are backed off predetermined distance, such as 0.1 mm or 0.5 mm, in step 167. Next in step 168, the other wheel head corresponding to the grinding portion which has not become a required value is infed again. When the gauging apparatus detects the diameter of grinding portion corresponding to the other wheel head became the required value in step 169, the other wheel head is backed off again in step 170. In step 171, both wheel heads are fed simultaneously only each backed off distance. And a spark-out process is executed with both wheel heads simultaneously in step 172.

Because manners from step 173 to step 178 are similar manners from step 132 to step 137 of Control Mode I, these are not explained.

At Control Mode I and Control Mode II, when the wheel head to which corresponding the diameter of the grinding portion became the required value is backed off first, as a value of the grinding force relative to the workpiece changes, a value of the deflection of the workpiece changes. Hereby, in the finish grinding process of the other wheel head, because the deflection of the workpiece changes, it may cause to deteriorate of accuracy at the finish grinding process of the other wheel head. But, according to Control Mode III, both wheel heads are backed off when the diameter of either grinding portion became to the required value, afterward the finish grinding process with the other wheel head is resumed. Therefore, Control Mode III has the advantage of accuracy relative to Control Mode I or Control Mode II.

4. Control Mode IV

Control Mode IV of the machining programs as fourth embodiment of the present invention will be explained hereinafter reference to FIG. 8. At Control Mode IV, in-process measuring is executed in a rough grinding process, too.

Machining operation is started (in step 180), each wheel head is indexed to a required grinding portion (in step 181), and each wheel head is fed rapidly (in step 182). Next, casting surfaces are ground by each grinding wheel (in step 183).

In step 184, the gauging apparatus 20R and 20L are engaged each grinding portion similarly in step 124 of Control Mode I. In step 185, the rough grinding process is started. While the rough grinding process is executing, in step 187 when either gauging apparatus detect a diameter of a grinding portion became a required value, in step 187 one wheel head corresponding to the grinding portion became the required value is backed off small distance, such as 0.1 mm or 0.5 mm, and the grinding wheel of one wheel head is disengaged to the grinding portion. During step 186 and 187, as infeed motion of the other wheel head is continued, the rough grinding process is executing with the other wheel hand. And, in step 188, when the other gauging apparatus detects a diameter of the other grinding portion became a required value, in step 189 one wheel head is fed only backed off distance in step 187.

In step 190, a finish grinding process is started. Because manners from step 190 to step 202 are similar manners from step 125 to step 137 of Control Mode I, these are not explained.

When a diameter of one grinding portion became a required value, if the finish grinding process of both wheel heads are started, as a diameter of the other grinding portion has not become a required value, a removable amount of the other grinding portion at the finish grinding process becomes larger than the same of one grinding portion. Therefore, it is occurred a problem which a cycle-time at the finish grinding process lengthens.

Meanwhile, when a diameter of one grinding portion became a required value, if the infeed motion of the wheel head corresponding to one grinding portion whose diameter became a required value is stopped until a diameter of the other grinding portion became a required value, as grinding force by one wheel head becomes not to act the workpiece, part of deflection of the workpiece spring-backs. Therefore, it is occurred a problem which one grinding portion whose diameter became the required value is ground because of the spring-back of the workpiece, so that a grinding allowance at the finish grinding process becomes less.

But, according to the Control Mode IV, as aforementioned two problems are not occurred, it can achieve high accuracy grinding.

The present invention can be employed for a crank-journal grinding machine, a cylindrical grinding machine, a cam grinding machine, a milling machine for crank-pin or camshaft, etc. instead of above described the crank-pin grinding machine.

Obviously, numerous modifications and variations of the present invention are possible in light of the above teachings. It is therefore to be understood that within the scope of the appended claims, the present invention may be practical otherwise than as specifically described herein.

What is claimed is:

1. A method of simultaneously machining at least two machining portions of a workpiece with plural tool heads, comprising:

executing a first matching process for said machining portions under measuring each diameter of said machining portions;

backing off one tool head predetermined distance, said one tool head corresponds one machining portion whose diameter became a required value during said first machining process; and executing a second machining process for said machining portions after diameters of all of said machining portions become each required value.

2. A method of simultaneously machining at least two machining portions of a workpiece with plural tool heads according to claim 1, wherein:

executing said second machining process after all of said tool heads backed off.

3. A method of simultaneously machining at least two machining portions of a workpiece with plural tool heads according to claim 1, wherein:

executing said second machining process without backing off one tool head corresponding to one machining portion whose diameter was lastly to become a required value.

4. A method of simultaneously machining at least two machining portions of a workpiece with plural tool heads, comprising:

executing a first machining process for said machining portions under measuring each diameter of said machining portions;

backing off all of said tool heads predetermined distance, when one of diameter of said machining portions became a required value during said first machining process;

resuming said first machining process for another machining portions whose diameter have not become each required value; and executing a second machining process for said machining portions after diameters of all of said machining portions became each required value.

5. A method of simultaneously machining at least two machining portions of a workpiece with plural tool heads according to one of claim 1–4, wherein:

said first machining process is finish machining process; and said second machining process is spark-out process.

6. A method of simultaneously machining at least two machining portions of a workpiece with plural tool heads according to claim 1, wherein:

said first machining process is rough machining process.

7. An apparatus for simultaneously machining at least two machining portions of a workpiece, comprising:

a base;

a worktable unit arranged on said base, which rotatably support the workpiece around predetermined axis;

at least two tool heads movably arranged on said base in a direction to cross said rotational axis of the workpiece, each of said tool heads supports a tool;

feeding units corresponding to said tool heads, said feeding units move each of said tool heads;

gauging units arranged corresponding to each of said machining portions, said gauging units measure each diameter of said machining portions at least during a first machining process; and a control unit controlling said feeding units according to signals of diameters provided from each of said gauging units; wherein controls all of said feeding units to execute a first machining process;

controls one feeding unit to back off one tool head predetermined distance, said one tool head corresponds one machining portion whose diameter became a required value during said first machining process; and controls all of said feeding units to execute a second machine process for said machining portions after diameters of all of said machining portions became each required value.

8. An apparatus for simultaneously grinding two grinding portions of a workpiece, comprising:

a base;

a worktable unit arranged on said base, which rotatably support the workpiece around predetermined axis;

two wheel heads movably arranged on said base in a direction to cross said rotational axis of the workpiece, each of said wheel heads supports a grinding wheel;

two feeding units corresponding to said wheel heads, said feeding units move each of said wheel heads;

two gauging units arranged corresponding to each of said grinding portions, said gauging units measure each diameter of said machining portions at least during a finish grinding process; and a numerical control unit controlling said feeding units according to signals of diameters provided from each of said gauging units; wherein controls both of said feeding units to execute a finish grinding process;

controls one feeding unit to back off one wheel head predetermined distance, said one wheel head corresponds one grinding portion whose diameter became a required value during said finish grinding process, and to keep backed off position of said one wheel head until a diameter of the other grinding portion become a required value; and controls both of said feeding units to execute a spark-out process for said machining portions after diameters of both of said machining portions became each required value.

* * * * *